United States Patent [19]

Saunders

[11] Patent Number: 4,657,261

[45] Date of Patent: Apr. 14, 1987

[54] SPRING MOUNTED SILHOUETTE ARCHERY TARGET APPARATUS

[76] Inventor: Charles A. Saunders, 8380-36th Ave., Columbus, Nebr. 68601

[21] Appl. No.: 816,341

[22] Filed: Jan. 6, 1986

[51] Int. Cl.[4] ..... F41J 3/00

[52] U.S. Cl. ..... 273/392; 273/408

[58] Field of Search ..... 273/127 D, 386, 391, 273/392, 403, 404, 407, 408

[56] References Cited

U.S. PATENT DOCUMENTS

| | | | |
|---|---|---|---|
| 518,930 | 4/1894 | Allen | 273/386 X |
| 1,831,289 | 11/1931 | Dally . | |
| 2,819,903 | 1/1958 | Saunders | 273/386 |
| 2,905,469 | 9/1959 | Taylor . | |
| 3,392,980 | 7/1968 | Ortega . | |
| 3,411,784 | 11/1968 | Lawrence | 273/392 X |
| 3,873,097 | 3/1975 | Willis | 273/127 D X |
| 4,093,227 | 6/1978 | Saunders et al. . | |
| 4,231,572 | 11/1980 | Thornton | 273/392 X |
| 4,433,843 | 2/1984 | Bricco | 273/408 X |

FOREIGN PATENT DOCUMENTS

| | | | |
|---|---|---|---|
| 915612 | 7/1946 | France | 273/386 |

OTHER PUBLICATIONS

Brochure entitled "Ethafoam ® Animal Targets with Replaceable Kill Areas", received Sep., 1984, one page.

*Primary Examiner*—Anton O. Oechsle
*Attorney, Agent, or Firm*—Henderson & Sturm

[57] ABSTRACT

A target apparatus having a structure for receivingly stopping and holding arrows which target is pivotally attached to a support member and biased to an upright position whereby when an arrow is shot into the target, it will pivot backwardly to absorb some of the shock of the impact of the arrow and which will then return to its original position for the next shot without a need to manually reset the target. An oscillation dampening structure is also provided on the target to cause such target to return to its original position as soon as possible after an arrow is shot into it.

5 Claims, 4 Drawing Figures

SPRING MOUNTED SILHOUETTE ARCHERY TARGET APPARATUS

TECHNICAL FIELD

The present invention relates generally to the field of archery, and more particularly to an improved target apparatus.

BACKGROUND ART

Targets are well known in the sport of archery for the purpose of providing something to shoot at which will stop the arrows and will prevent loss or damage to such arrows. One of the most common and well known of such target devices is a matt which is wound from grass or hay and upon which a paper target is placed. The paper target provides reference points for the archer to shoot at, and the matt behind it actually stops the arrow before the fletching passes therethrough.

Other types of targets and arrow stopping devices are also in common usage. For example, there are styrofoam or other types of solid foam targets, some of which are molded into the shapes of animals or have an animal imprinted on the front thereof. Many of these are three dimensional, but a common target of this type is also a flat silhouette in the shape of a particular animal, sometimes having the features of such animal painted on the front thereof.

These foam silhouette targets are sometimes anchored to the ground and at other times they merely set on the ground on a platform attached to the bottom thereof. On these silhouette targets which are merely held upright by gravity, once they are hit by an arrow, they are pushed rearwardly by the force of the arrow and often come to rest in something other than an upright position, thereby requiring that the target be set upright and placed at the distance desired in order for a second shot to be made at such target. If the silhouette target is solidly or rigidly attached to the ground, for example by using a ground stake, then the arrows will tend to pass through such silhouette target and eventually a hole will be blown out of the area where most of the arrows are striking the silhouette target.

Once there is a hole in a silhouette target, it defeats the purpose of stopping the arrow and preventing damage to the arrows and to the target itself. When arrows pass through such a target, it is difficult to determine exactly where the arrow passed through, and therefore the arrow is difficult to score. Also, the arrow can be lost in the grass or the like behind the target. When the arrow passes through the target, the fletching often is torn off or damaged as it hits portions of the target.

Consequently there is a need for a silhouette target apparatus which will absorb the shock of the arrow and stop the arrows to allow the arrows to be properly scored, to prevent damage to the target itself, and to prevent damage to or loss of the arrows. Also, there is a need for a silhouette target which has the aforementioned shock absorbing abilities and which is also automatically reset to the same position each time after each arrow impacts the target.

DISCLOSURE OF THE INVENTION

The present invention relates to a target apparatus having a structure for receivingly stopping and holding arrows, which target is pivotally attached to a support member and biased to an upright position whereby when an arrow is shot into the target, it will pivot backwardly to absorb some of the shock of the impact of the arrow and which will then return to its original position for the next shot without a need to manually reset the target. An oscillation dampening structure is also provided on the target to cause such target to return to its original position as soon as possible after an arrow is shot into it.

The present invention relates to an improved target apparatus for archery.

Another object of the present invention is to provide a target apparatus which will absorb the shock of an arrow shot into it.

A further object of the present invention is to provide an automatic resetting mechanism for a silhouette archery target.

A still further object of the present invention is to provide an archery target apparatus of the aforementioned type which will include a shock absorbing apparatus which will automatically reset to the original position of the target after an arrow strikes the target.

An even further object of the present invention is to provide an archery target apparatus of the aforementioned type which will prevent the arrows from passing therethrough which will also preserve the life of the target and will prevent loss or damage of arrows shot into such target apparatus.

Other objects, advantages, and novel features of the present invention will become apparent from the following detailed description of the invention, when considered in conjunction with the accompanying drawings.

BEST MODE FOR CARRYING OUT THE INVENTION

Figure 1:
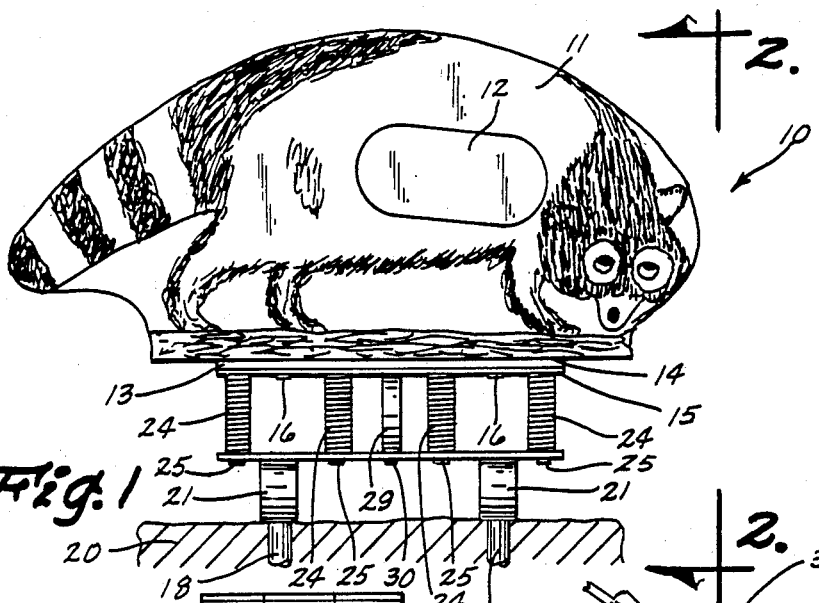
FIG. 1 is a front elevational view of a silhouette target apparatus for archery constructed in accordance with the present invention.

Referring now to the drawings, wherein like reference numerals designate identical or corresponding parts throughout the several views, FIG. 1 shows a spring mounted silhouette archery target apparatus (10) constructed in accordance with the present invention.

The target apparatus (10) includes three back-to-back and glued together styrofoam members (11), each having a vital portion (12) of foam material which is more dense than the area outside of the vital portion (12). The purpose of having a more dense area within the vital portion (12) is because typically more arrows will enter the portion (12) for the reason that it is the portion which archers are trying to hit. The front face of the front one of the styrofoam members (11) has the shape of a raccoon imprinted thereon, although this does not necessarily constitute a necessary element of the present invention. It will also be understood to those skilled in the art that the shapes of other animals can be formed by layers (11) and that accordingly, other corresponding imprints will be made to the front of the front layer (11) of such targets.

Figure 4:
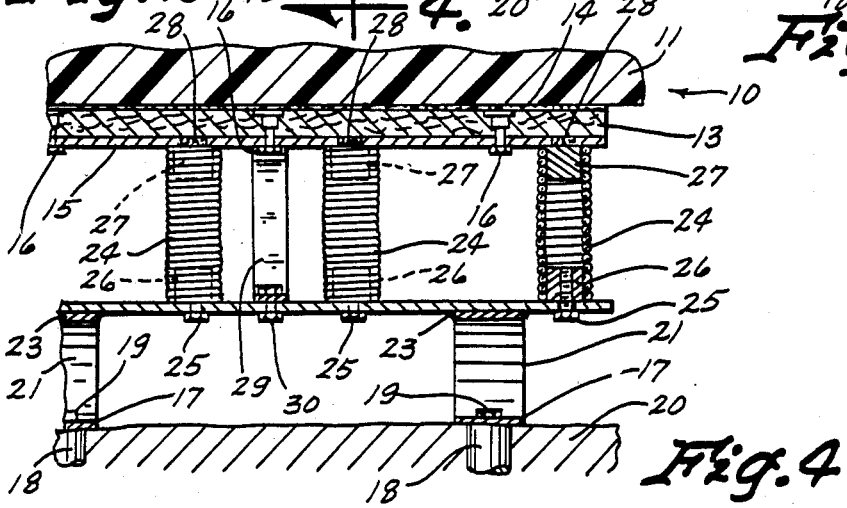
FIG. 4 is an enlarged partial cross sectional view taken along line 4—4 of FIG. 2.

Referring to FIG. 4, it is noted that a board or other rigid member (13) is glued to the bottom of the three styrofoam members (11) by an adhesive (14). A metal plate (15) is bolted to the wooden board member (13) by threaded nut and bolt fasteners (16).

Figure 2:
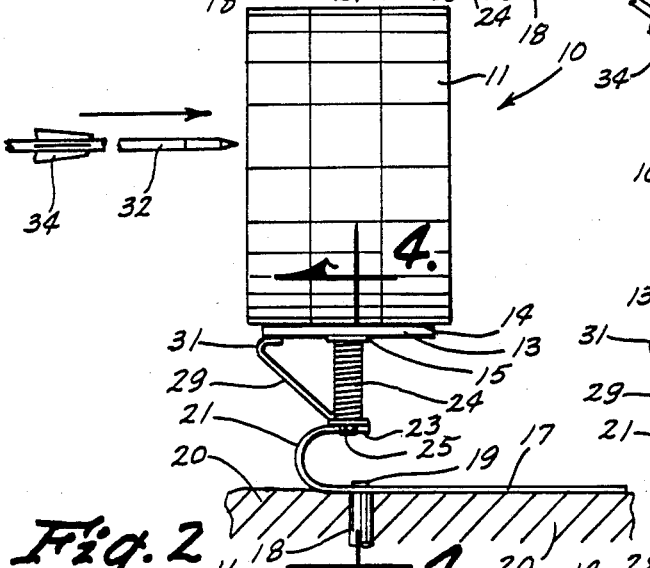
FIG. 2 is a side elevational view taken along line 2—2 of FIG. 1 and showing an arrow about to strike the target.
Figure 3:
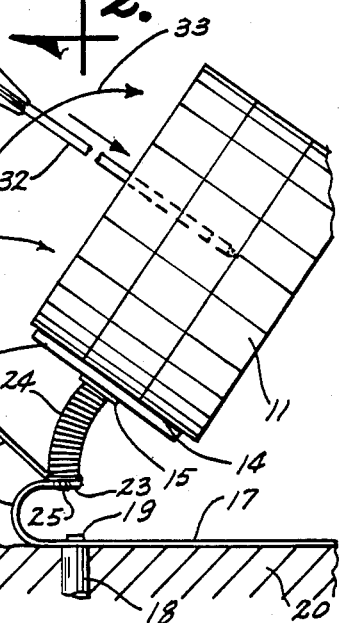
FIG. 3 is a side elevational view like FIG. 2, but showing the shock absorbing feature of the preferred embodiment just after an arrow has impacted the target.

A support member (17) is shown in FIGS. 1-3 as having a ground engaging stakes (18) bolted thereon by a threaded fastener (19). These stakes (18) are pushed into the ground (20) to hold the apparatus (10) in the position shown in FIGS. 1 and 2, but it will be understood that the support member (17) could be fastened to a floor or other supporting surface, rather than being outdoors and attached to the ground.

The support member (17) has an upwardly extending curved portion (21) attached thereto and a metal strap (22) is welded to the top of the portion (21) of support member (17), such as by welds (23) shown in FIG. 4.

A plurality of springs (24), of a helical type, are attached between the plate (15) and the strap (22) by use of bolts (25) threadably received into members (26) which have an outside diameter slightly larger than the inside diameter of the springs (24) so that friction will hold the springs (24) onto the post (26). Posts (27) are similarly rigidly attached to the plate (15), for example by having openings in the plate (15) in a press-fit relationship with respect to post (28); alternatively, the post (28) can be welded to the plate (15) or they can be attached in the manner that the post (26) is attached to the strap (22).

Referring to FIGS. 2 and 4, for example, it is noted that a oscillation dampening stop member (29) is bolted to the strap (22) by a nut and bolt fastener (30). This stop member (29) has a curved free end (31) which contacts the front bottom portion of the board (13), as shown in FIG. 2 when the apparatus (10) is in the at-rest position in readiness to have an arrow (32) shot into it.

In operation of the preferred embodiment (10) of the present invention, an archer would face the target apparatus (10) generally from the front thereof so that it would be viewed similar to the view from FIG. 1, although the archer could obviously stand somewhat to one side or the other if desired. Once the arrow (32) shown in FIG. 2 is shot, it will enter the front of members (11 or 12) and the force of the arrow (32) will cause the target apparatus to move to the position shown in FIG. 3, generally causing a pivoting motion in the direction of the arrow (33). The impact of the arrow (32) will be absorbed by the helical spring (24) and by the members (11) or (12), causing the springs (24) to bend as shown in FIG. 3.

After the shock of impact of the arrow (32) has been absorbed, then the springs will automatically bias the layers (11 and 12) of the target apparatus (10) back to the position shown in FIG. 2 and the front bottom portion of the board (13) will contact the top free end of the stop member (29). If this stop member (29) was not provided, the target layers (11) would continue to oscillate and cause the ancher to wait to shoot the next arrow until the target has stopped moving. Also, this oscillation would tend to be noisy and would tend to cause excessive wear on the springs (24) and associated parts thereof.

The pivoting motion shown between FIG. 2 and FIG. 3 is caused by the force of the arrow (32) about a moment arm which extends from somewhere generally in the center portion of the springs (24), up to the point where the arrow impacts the target. As this occurs, the extra inertial force will cause more friction between the top of the arrow and the top of the hole where the arrow enters the target that if this pivoting did not occur, i.e., that if the members (11 and 12) were held stationary and could not move from the position shown in FIG. 2. Consequently, the arrows (32) will not penetrate the layers (11) as much as if this structure was not provided and consequently this novel pivoting construction will prevent arrow "pass-throughs" which will extend the life of the target apparatus (10) and will prevent loss or damage of the arrows (33). If the fletching portion (34) of the arrow (32) extends into the layers (11 or 12) of the target apparatus (10), they will be damaged, since they are made of feathers or thin, fragile, plastic flexible material which are merely glued to the shaft of the arrow (32).

Accordingly, it will be appreciated that the aforementioned preferred embodiment of the present invention does indeed accomplish the aforementioned objects. Obviously, many modifications and variations of the present invention are possible in light of the above teachings. It is therefore to be understood that, within the scope of the appended claims, the invention may be practised otherwise than as specifically described.

I claim:

1. An archery target apparatus comprising:

target means for receivingly stopping and holding arrows;

a support member;

at least one helically shaped spring having a longitudinal axis normally disposed generally transversely with respect to the path of arrows entering said target means;

means for attaching one end of said spring to said support member;

means for operably attaching the other end of said spring to said target means whereby said spring will bias said target means to a first position and will permit said target means to move rearwardly to a second position when an arrow enters said target means, for absorbing the force of impact of the arrow on said target means; and oscillation dampening means operably attached to said support member for reducing the oscillation of said target means after an arrow has impacted the target means, said oscillation dampening means comprises a stop member having one end operably attached to said support member and the other end being a free end operably contacting a front bottom portion of said target means, said stop member being a long and thin metal strap which will bend within its elastic range to absorb some of the shock of the target means when it moves forwardly from the second to the first position thereof.

2. The archery target apparatus of claim 1 including means for attachment of said support surface to the ground.

3. The archery target apparatus of claim 2 wherein said target means comprises a foam arrow receiving material having a mounting member on the bottom thereof constructed of more rigid material than said foam material.

4. The archery target of claim 1 wherein said support member comprises at least one sheet metal member, a lower portion of said sheet metal member being horizontally disposed for attachment to the ground or a floor and an upper portion of said sheet metal member curving up about 180 degrees from the lower portion, the lower part of said spring being operatively connected to a plate connected to said upper portion of said sheet metal member.

5. The archery target of claim 4 wherein a plurality of helical springs are each operatively attached at the top thereof to said target means and at the bottom thereof to said support member, each of said helical springs having a generally vertically disposed longitudinal axis.

* * * * *